US008056894B2

(12) United States Patent
Ichikawa

(10) Patent No.: US 8,056,894 B2
(45) Date of Patent: Nov. 15, 2011

(54) IMAGE FORMING APPARATUS

(75) Inventor: Hiroshi Ichikawa, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 197 days.

(21) Appl. No.: 12/510,911

(22) Filed: Jul. 28, 2009

(65) Prior Publication Data

US 2010/0019443 A1 Jan. 28, 2010

(30) Foreign Application Priority Data

Jul. 28, 2008 (JP) ..... 2008-193635
Jun. 5, 2009 (JP) ..... 2009-135859

(51) Int. Cl.
*B65H 5/00* (2006.01)

(52) U.S. Cl. ..... 271/10.01; 271/10.09; 271/10.11

(58) Field of Classification Search ..... 271/10.01, 271/10.09, 10.11, 264; 399/107
See application file for complete search history.

(56) References Cited

U.S. PATENT DOCUMENTS 7,062,216 B2 6/2006 Nobe et al.
7,454,155 B2 * 11/2008 Tomatsu ..... 399/107
2006/0198657 A1 * 9/2006 Tsujimoto ..... 399/107
2007/0154234 A1 * 7/2007 Tomatsu ..... 399/107
2007/0160382 A1 * 7/2007 Tomatsu ..... 399/107
2007/0201899 A1 * 8/2007 Fukuda ..... 399/107
2008/0310879 A1 * 12/2008 Kotsuka et al. ..... 399/107

FOREIGN PATENT DOCUMENTS

JP H06-027752 A 2/1994
JP H08-188270 A 7/1996
JP H08-225161 A 9/1996
JP 2002-293443 A 10/2002
JP 2004-154974 A 6/2004
JP 2007-148142 A 6/2007

* cited by examiner

*Primary Examiner* — David H Bollinger
(74) *Attorney, Agent, or Firm* — Baker Botts L.L.P.

(57) ABSTRACT

An image forming apparatus includes an image forming unit, a feeder unit, and a frame unit. The frame unit includes a pair of plate-like metal frames, each plate-like metal frame having an inner surface extending in a parallel direction to a sheet feeding path and in a perpendicular direction of a surface of a recording sheet, and a plurality of connecting frames connecting and holding the metal frames to be apart from each other. The image forming unit is arranged in space defined by the connecting frames and held by the metal frames to be substantially fitted in between the metal frames. The feeder unit is attached to an end of each of the metal frames by an attachment system provided on each widthwise side of the feeder unit. The attachment system fixes the feeder unit along a direction in parallel with the inner surfaces of the metal frames.

10 Claims, 10 Drawing Sheets

FIG.8A
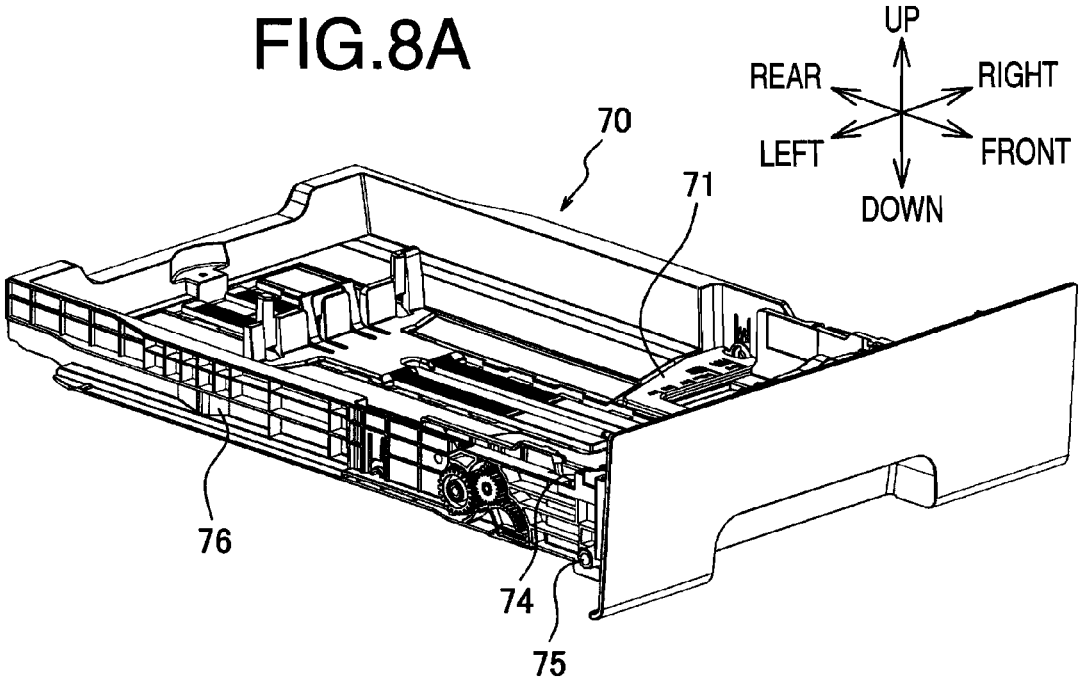
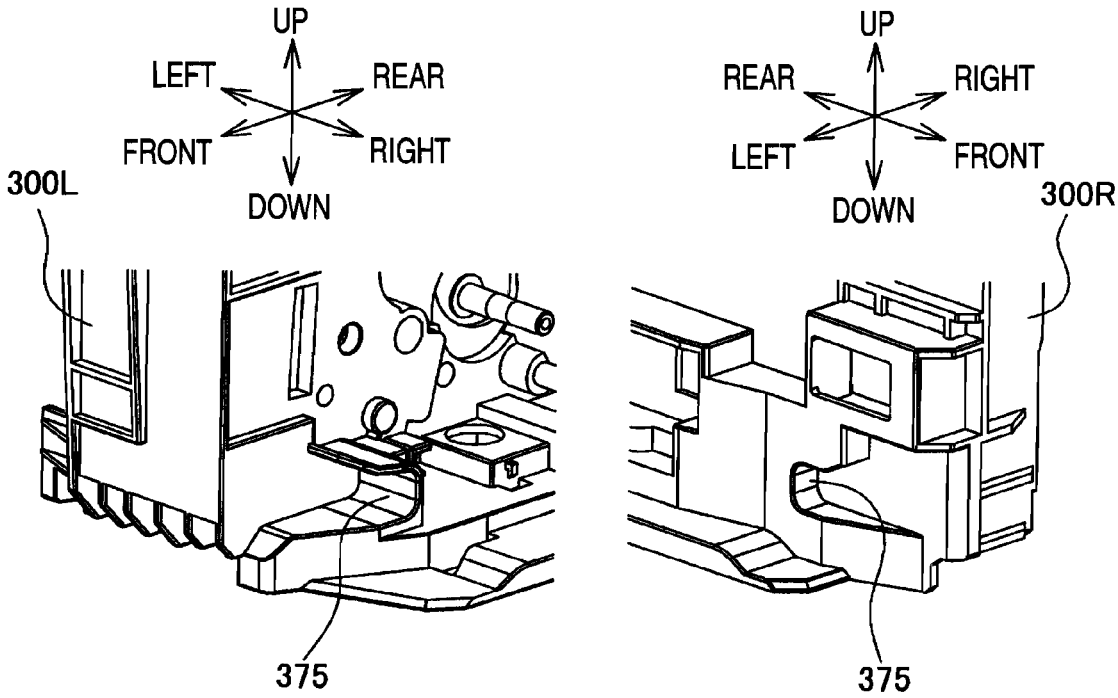
FIG.8B

IMAGE FORMING APPARATUS

CROSS REFERENCE TO RELATED APPLICATION

This application claims priority from Japanese Patent Application Nos. 2008-193635, filed on Jul. 28, 2008, and 2009-135859, filed on Jun. 5, 2009, the entire subject matter of which is incorporated herein by reference.

BACKGROUND

1. Technical Field

An aspect of the present invention relates to an image forming apparatus having an image forming unit to form an image on a recording medium, a feeder unit to feed the recording medium to the image forming unit, and frames to hold the image forming unit and the feeder unit.

2. Related Art

An image forming apparatus having an image forming unit to form an image on a recording medium in, for example, an electrophotographic method has been known. The image forming apparatus may be equipped with a pair of frames to hold the image forming unit, which are arranged on each side with respect to a feeding direction.

When the recording medium is fed in a feeding path to the image forming unit by a feeder unit having a feeding component such as a feed roller, it is required that the feeder unit is in a specific position with respect to the image forming unit. In an image forming apparatus disclosed in Japanese Patent Provisional Publication No. 2004-154974, for example, the feeder unit is attached to the image forming apparatus with a pair of frames, which are angled substantially orthogonally, so that the feeder unit is settled in a correct position defined by the orthogonal surfaces of the frames.

SUMMARY

When the frames are made of resin, the resin may thermally expand or contract upon molding or during image forming operations; and therefore, the accurate positioning of the feeder unit by the frame may not be steadily maintained. Although the frames may be made of metals, metal frames may also not steadily and accurately maintain their bent shapes.

In view of the above drawbacks, the present invention is advantageous in that an image forming apparatus having a feeder unit, which can be set in an accurate position with respect to frames of the image forming apparatus to hold an image forming unit, is provided.

According to an aspect of the present invention, an image forming apparatus is provided. The image forming apparatus includes at least one image forming unit configured to form an image on a recording sheet which is conveyed along a sheet feeding path, a feeder unit configured to feed the recording sheet in the sheet feeding path, and a frame unit configured to support the image forming unit and the feeder unit. The frame unit includes a pair of plate-like metal frames, each arranged on each side of the sheet feeding path, each plate-like metal frame having an inner surface extending in a parallel direction to the sheet feeding path and in a perpendicular direction of a surface of the recording sheet, the inner surfaces facing each other. The frame unit further includes a plurality of connecting frames, which connect and hold the metal frames to be apart from each other. The image forming unit is arranged in space defined by the plurality of connecting frames and is held by the pair of metal frames to be substantially fitted in between the pair of metal frames. The feeder unit is attached to an end of each of the pair of metal frames by an attachment system provided on each widthwise side of the feeder unit, the attachment system fixing the feeder unit to the pair of metal frames along a direction in parallel with the inner surfaces of the metal frames.

According to the above configuration, the feeder unit is attached in a correct position with respect to the frame unit. Because the frame unit holds the image forming unit therein, when the feeder unit is attached in the correct position with respect to the frame unit, the image forming unit is installed in a correct position with respect to the feeder unit. Therefore, the recording sheet can be fed correctly in the sheet feeding path so that the image can be formed by the image forming unit on a correct position of the recording sheet.

BRIEF DESCRIPTION OF THE ACCOMPANYING DRAWINGS

FIGS. 8A and 8B are perspective views of a positioning mechanism of the sheet cassette to position the sheet cassette with respect to the resin frames in the printer according to the embodiment of the present invention.

DETAILED DESCRIPTION

Hereinafter, an embodiment according to an aspect of the present invention will be described with reference to the accompanying drawings.

Figure 1:
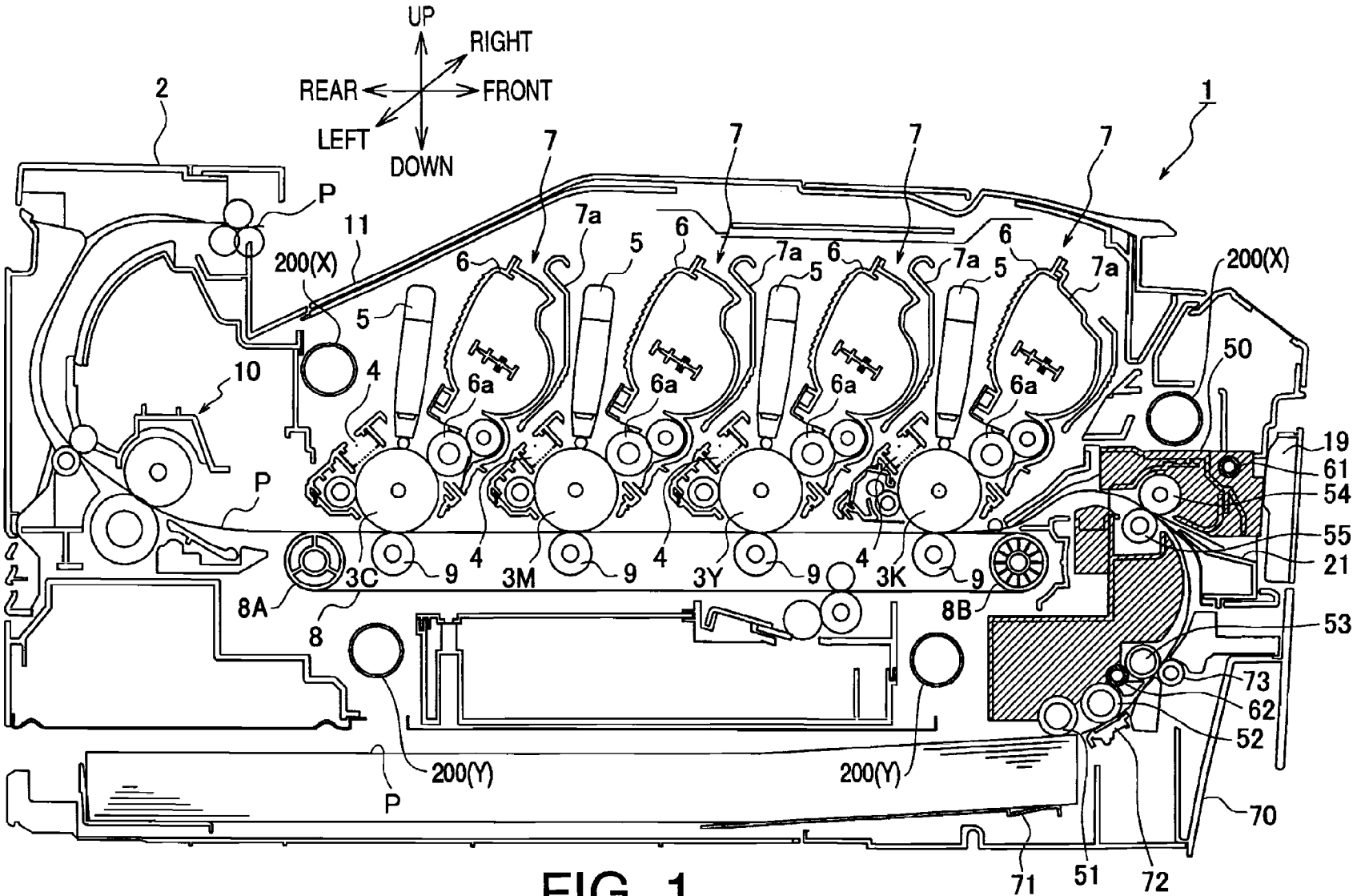
FIG. 1 is a cross-sectional side view of a printer according to an embodiment of the present invention.

FIG. 1 is a cross-sectional side view of a printer 1 as an example of an image forming apparatus according to an embodiment of the present invention. In the present embodiment, directions concerning the printer 1 will be referred to based on the orientation of the printer 1 shown in FIG. 1. A right-left direction of the printer 1 refers to a direction perpendicular to the cross-section of the printer 1 in FIG. 1, and is also referred to as a widthwise direction. In FIG. 1, hatching in cross-sections of the casing 2 in the printer 1 is omitted for reasons of expediency. Instead, cross-sections of a feeder unit 50 are indicated with hatching.

The printer 1 is a direct-tandem color LED printer with a casing 2, in which four photosensitive drums 3 are arranged in line in a front-rear direction. The photosensitive drums 3 include a photosensitive drum 3K for black, a photosensitive drum 3Y for yellow, a photosensitive drum 3M for magenta, and a photosensitive drum 3C for cyan. Each of the photosensitive drums 3A is arranged to oppose a scorotron charger 4, an LED unit 5, and a rotatable developer roller 6*a*.

Each of the photosensitive drums 3 includes a drum body (not shown) and a positively chargeable photosensitive layer (not shown) covering the drum body. A surface of the photosensitive layer is positively charged by the scorotron charger 4 and exposed to beam that scans the surface of the photosensitive drum 3 according to image data, which represents an image to be formed on a recording medium. Thus, a latent image is formed on the surface of the photosensitive drum 3.

The developer roller 6*a* is rotatably arranged in a lowermost portion of a developer cartridge 6, which contains non-magnetic mono-component toner therein. The developer roller 6*a* frictionally charges the toner positively and carries the charged toner in a thin layer on a surface thereof. The positively charged toner is thus supplied to the photosensitive drum 3. As the photoconductive drum 3 with the latent image on the surface thereof is rotated, the toner positively charged on the surface of the developer roller 6*a* is transferred and adhered to the lower-potential region, which corresponds to the latent image on the surface of the photosensitive drum 3. Thus, the latent image is developed to be a toner image on the surface of the photosensitive drum 3. The photosensitive drum 3, the scorotron charger 4, and the developer cartridge 6 are contained in a casing 7*a* of a processing cartridge 7.

In each of the processing cartridges 7, the photosensitive drums 3, the scorotron chargers 4, and the developer roller 6*a* are arranged in space enclosed by four flanged pipes 200. The processing cartridges 7 are removably installed in the printer 1 through an inlet (not shown) which is exposed when a discharge tray 11 is uplifted. The discharge tray 11 is attached to the casing 2 of the printer 1 and swingable about a rear end thereof.

The four flanged pipes 200 are linear connecting frames to extend in parallel with one another in the right-left direction to connect and hold metal frames 100, which will be described later in detail, steadily apart from each other. The four flanged pipes 200 include two pipes 200X at upper positions and two pipes 200Y at lower positions. Distance between the two upper pipes 200X in the front-rear direction is greater than distance between the two lower pipes 200Y in the front-rear direction so that the processing cartridges 7 can be inserted in and retracted from the printer 1 from above through the inlet between the two upper pipes 200X. As shown in FIG. 1, a cross-sectional shape of the space defined by the four flanged pipes 200 is trapezoidal, and the flanged pipes 200 are not aligned in line vertically but dispersed in the front-rear direction. Thus, the flanged pipes 200 to support the metal frames 100 are distributed in the front-rear directions. Therefore, external force conducted to the metal frames 100 can be distributed to the flanged pipes 200 so that the space defined by the flanged pipes 200 can be less affected by the external force and the processing cartridges 7 arranged in the space can be maintained steadily in predetermined positions.

Recording sheets P are recording media to have images printed thereon by the printer 1 in the present embodiment. The recording sheets P are stored in a sheet cassette 70, which is removably installed in a bottom portion of the casing 2 of the printer 1. As shown in FIG. 1, the sheet cassette 70 is arranged to be in substantially parallel with a conveyor belt 8. When recording sheets P are refilled in the sheet cassette 70, the sheet cassette 70 is drawn toward the front. The recording sheets P stored in the sheet cassette 70 are carried by rotation of rollers equipped in a feeder unit 50, which will be described later in detail, in a sheet feeding path curved in an approximate U shape and led to the conveyor belt 8. The conveyor belt 8 is an endless belt extended along the sheet feeding path to encircle a driving roller 8A and a driven roller 8B, and arranged to vertically overlap the sheet cassette 70 and the processing cartridges 7. The conveyor belt 8 is opposed to the photosensitive drums 3K, 3Y, 3M, and 3C, which are arranged above the conveyor belt 8. Further, transfer rollers 9 are disposed in positions to oppose to the photosensitive drums 3 respectively via the conveyor belt 8. With the sheet cassette 70, the conveyor belt 8, and the processing cartridges 7 being vertically overlapped, a height of the entire printer 1 can be reduced. The toner images formed on the photosensitive drums 3 are sequentially transferred and overlaid one over the other on a surface of the recording sheet P, which is carried by the conveyor belt 8, by a predetermined level of transfer bias applied to the transfer rollers 9.

The recording sheet P with the transferred four colored toner images is conveyed to a fixing unit 10, in which the four colored images are thermally fixed to the surface of the recording sheet P. The recording sheet P is thereafter carried by rollers to be discharged in the discharge tray 11.

Next, internal configurations of the feeder unit 50 and the sheet cassette 70 will be described. As shown in FIG. 1, the sheet cassette 70 contains a stack of recording sheets P therein. The stack of recording sheets P is supported by a pressure plate 71 to be upraised at a front portion thereof. The feeder unit 50 includes a feed roller 51 and a separator roller 52. The feeder unit 50 is arranged in the vicinity of a starting point of the sheet feeding path within the pair of metal frames 100 in the printer 1 so that the sheet carried in the feeder unit 50 can be fed continuously in the sheet feeding path in between the pair of frames 100. The feed roller 51 is arranged in a position which opposes an upper front end of the sheet cassette 70. The separator roller 52 is arranged in a downstream side with respect to the feed roller 51 in a sheet feeding direction. A topmost recording sheet P in the stack is picked up by rotation of the feed roller 51, and separated from the stack by rotation of the separator roller 52 and friction with a separator pad 72.

The topmost recording sheet P is thereafter conveyed by rotation of a conveyor roller 53, which is provided in the feeder unit 50, and a roller 73, which is provided in the sheet cassette 70, and forwarded to enter in between a pair of register rollers 54, 55, which are provided in the feeder unit 50. When a front or leading end of the recording sheet P reaches the register rollers 54, 55, the recording sheet P is paused to be straighten its orientation by the pair of register rollers 54, 55. The recording sheet P is forwarded in the sheet feeding path on the conveyor belt 8 after a predetermined time period by the register rollers 54, 55. Thus, the recording sheets P are fed in the sheet feeding path by the feed roller 51, the separator roller 52, the conveyor roller 53, and the register rollers 54, 55.

A front portion of the casing 2 includes a manual sheet holder 19, which can be extended outwardly to hold recording sheets (not shown). The recording sheets set on the manual sheet holder 19 are withdrawn through an inlet 21, which is provided at the front portion of the casing 2, and fed in the sheet feeding path to enter in between the register rollers 54, 55. Thus, the recording sheet P is forwarded in the sheet feeding path on the conveyor belt 8.

Next, a frame structure of the printer 1 according to the present embodiment will be described with reference to FIGS. 2 and 3.

The printer 1 according to the present embodiment includes a pair of plate-like metal frames 100, which are set to be apart from and in parallel with each other with a predetermined distance therebetween so that a width of the processing cartridges 7 can be substantially fitted therein. The printer 1 further includes a pair of resin frames 300, which are set outer sides (i.e., outside left and outside right) of the metal frames 100. The pair of metal frames 100 includes a left-side metal frame 100L and a right-side metal frame 100R. The pair of resin frames 300 includes a left-side resin frame 300L and a right-side resin frame 300R.

Figure 2:
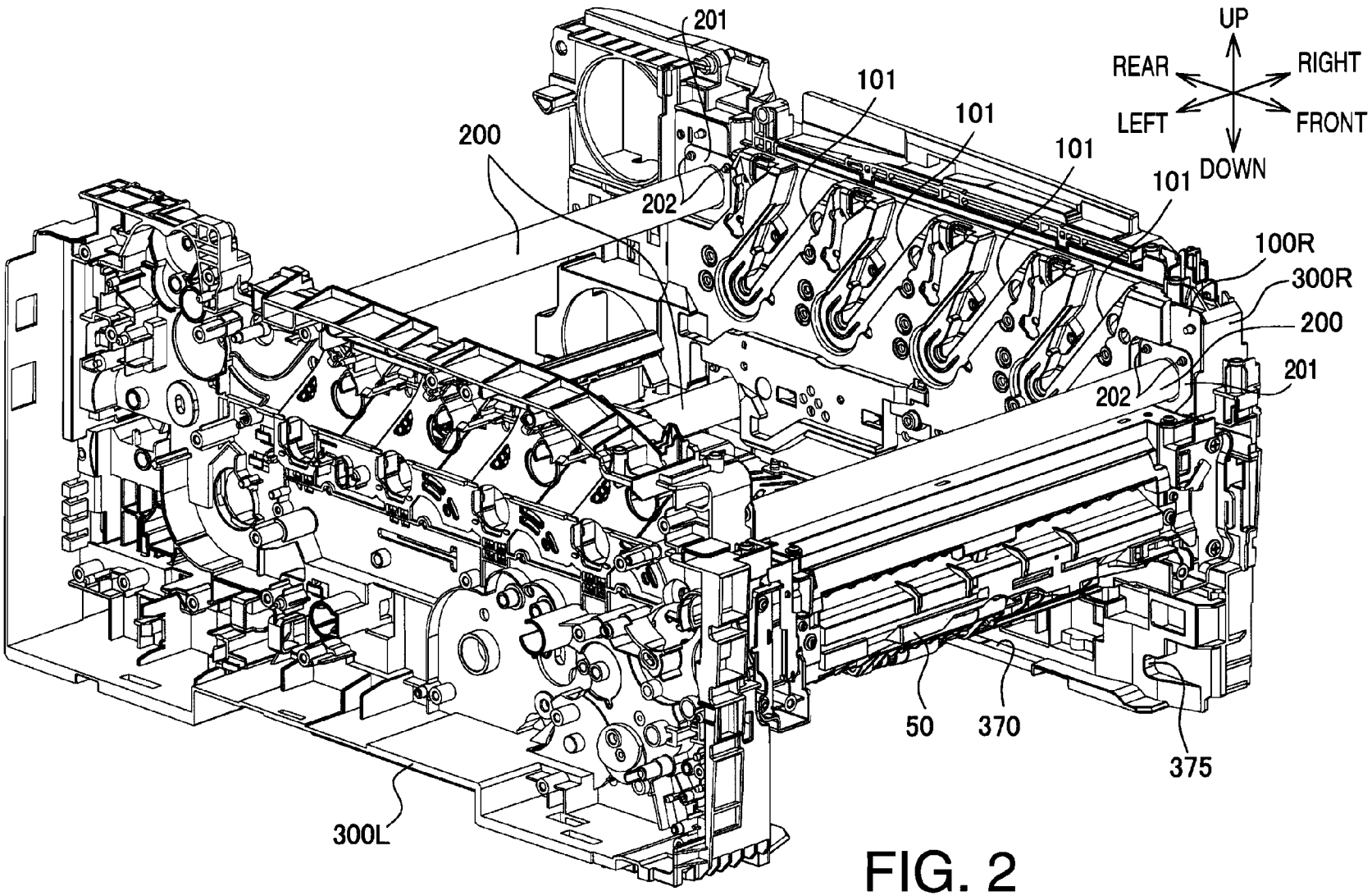
FIG. 2 is a perspective view of a frame structure of the printer according to the embodiment of the present invention.
Figure 3:
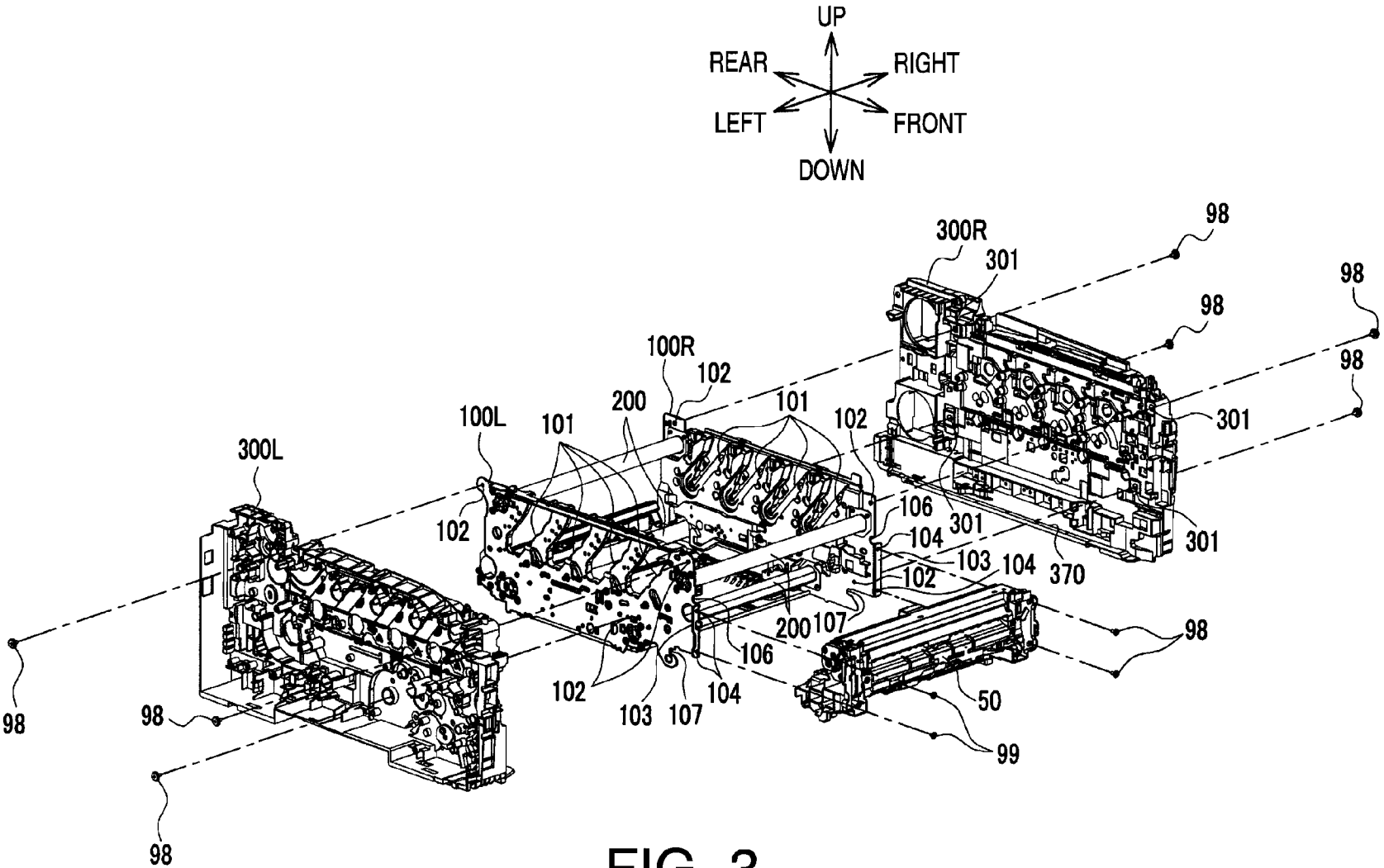
FIG. 3 is an exploded view of the frame structure of the printer according to the embodiment of the present invention.

As shown in FIGS. 2 and 3, the left-side metal frame 100L and the right-side frame 100R of the metal frames 100 are connected with each other by the four flanged pipes 200. Each of the metal frames 100 is formed to have guide grooves 101 to guide the processing cartridges 7 in correct positions, and the guide grooves 101 are arranged in the space defined by the four flanged pipes 200. As the processing cartridges 7 are steadily maintained in the space secured by the flanged pipes 200 between the metal frames 100, displacements of the colored images to be overlaid can be avoided from occurring.

Each of the flanged pipes 200 is formed to have flanges 201 at each end thereof so that the flanged pipes 200 can be fixed to the metal frames 100 by screws 202. On the outer surfaces of the left-side metal frame 100L and the right-side metal frame 100R of the metal frames 100, the left-side resin frame 300L and the right-side resin frame 300R of the resin frames 300 are fixed respectively by screws 98.

Figure 4A:
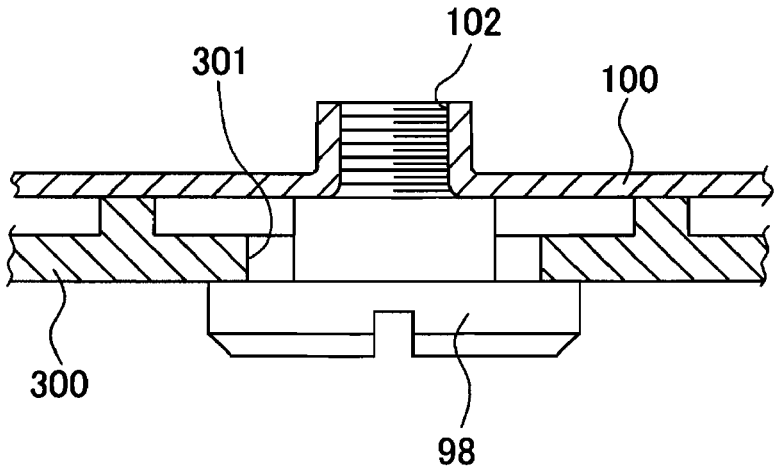
FIG. 4A illustrates attachment of a metal frame with a resin frame in the frame structure of the printer according to the embodiment of the present invention.

As shown in FIG. 4A, the screw 98 is a shoulder screw, which is mounted to penetrate through a hole 301 formed in the resin frame 300 and screwed in a screw hole 102 of the metal frame 100. The hole 301 of the resin frame 300 is formed to have a length of the opening in the front-rear direction greater than a diameter of a shoulder portion of the screw 98. With this structure, the resin frame 300 and the metal frame 100 are attached to each other, but the attachment is not tight enough to prohibit the resin frame 300 and the metal frame 100 from moving relatively to each other. In other words, the attachment is loose enough to absorb deformation of the resin frame 300 and the metal frame 100 even when coefficients of linear thermal expansion of the resin frame 300 and the metal frame 100 vary.

Figure 4B:
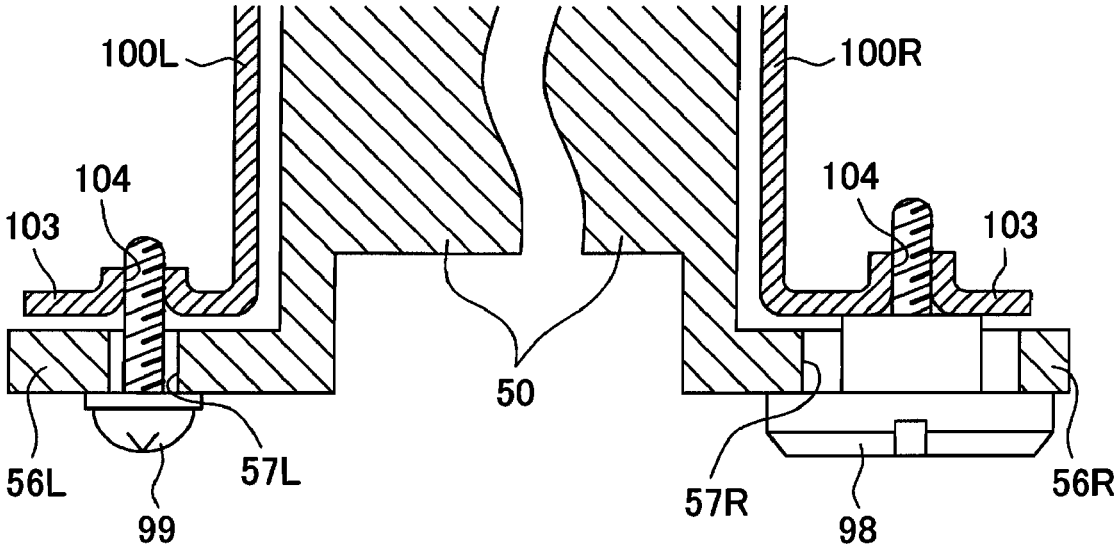
FIG. 4B illustrates attachment of the metal frame and a feeder unit of the printer according to the embodiment of the present invention.

As shown in FIG. 4B, the feeder unit 50 is fixed to the pair of metal frames 100 with the shoulder screws 98 and shoulderless screws 99. More specifically, the feeder unit 50 is fixed to the right-side metal frame 100R with the shouldered screws 98 and fixed to the left-side metal frame 100L with the shoulderless screws 99. The feeder unit 50 is arranged in a front portion of the printer 1, more specifically, anterior to the conveyor belt 8 in a direction perpendicular to a vertical direction, in which the conveyor belt 8, the sheet cassette 70, and the processing cartridges 7 vertically overlap. Moreover, the feeder unit 50 is arranged in a position outside the space defined by the four flanged pipes 200. Therefore, the processing cartridges 7 can be prevented from being affected by movement of the feeder unit 50 such as vibration.

Figure 5:
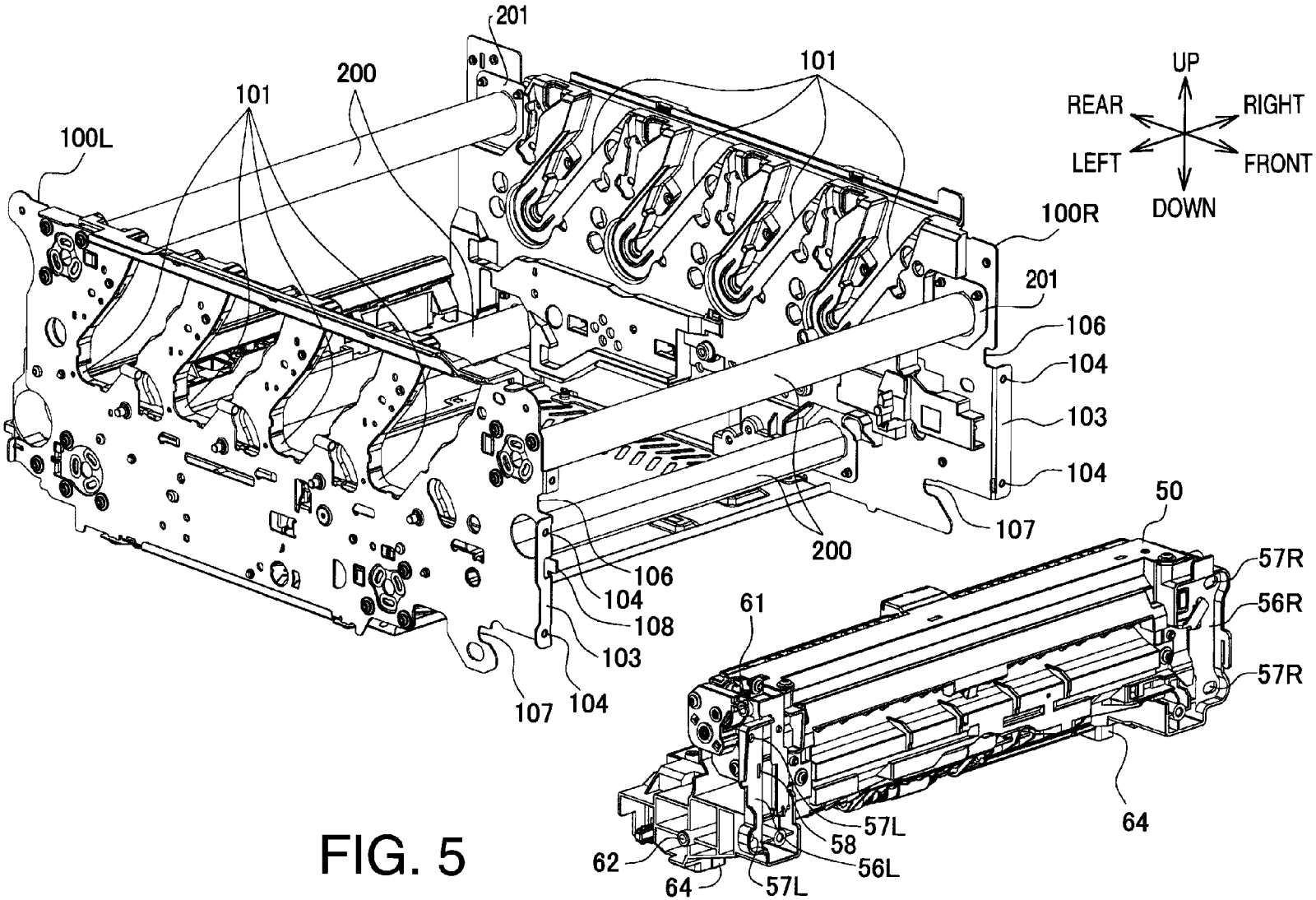
FIG. 5 is an exploded view of the pair of metal frames and the feeder unit in the printer according to the embodiment of the present invention.
Figure 6A:
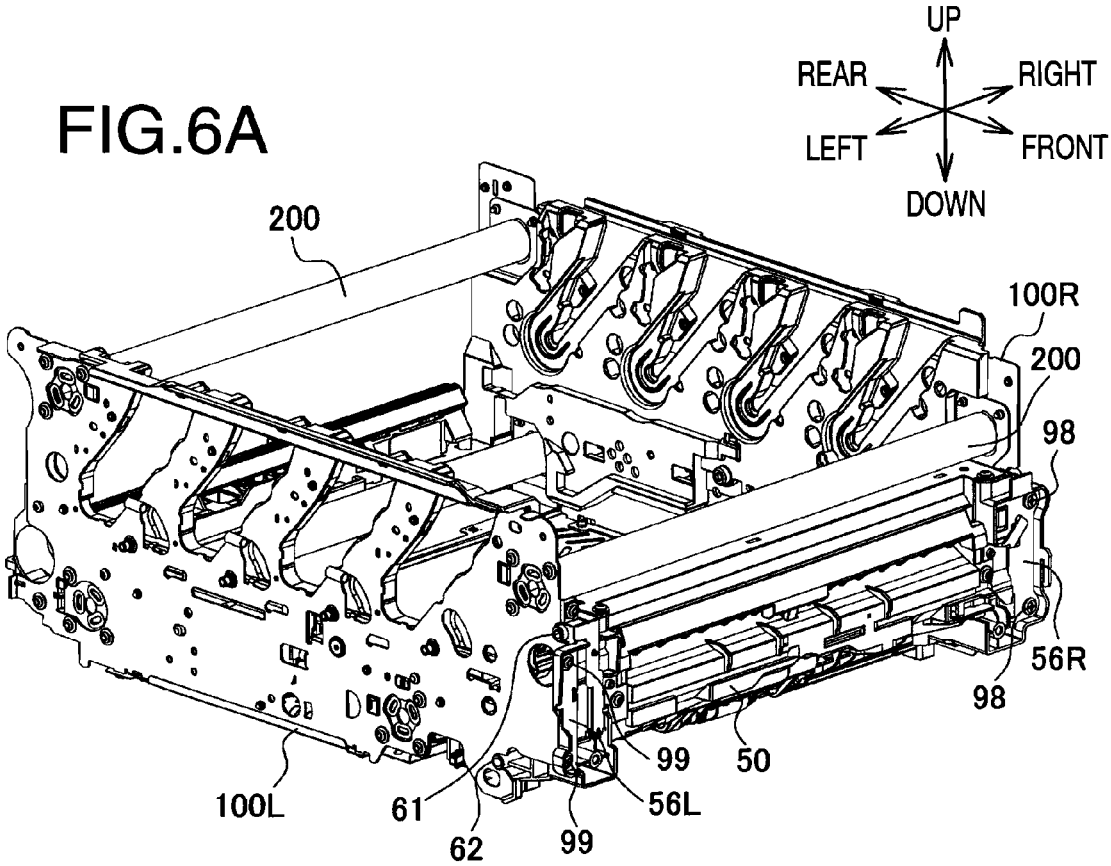
FIG. 6A is a perspective view of the pair of metal frames with the feeder unit attached thereto in the printer according to the embodiment of the present invention.
Figure 6B:
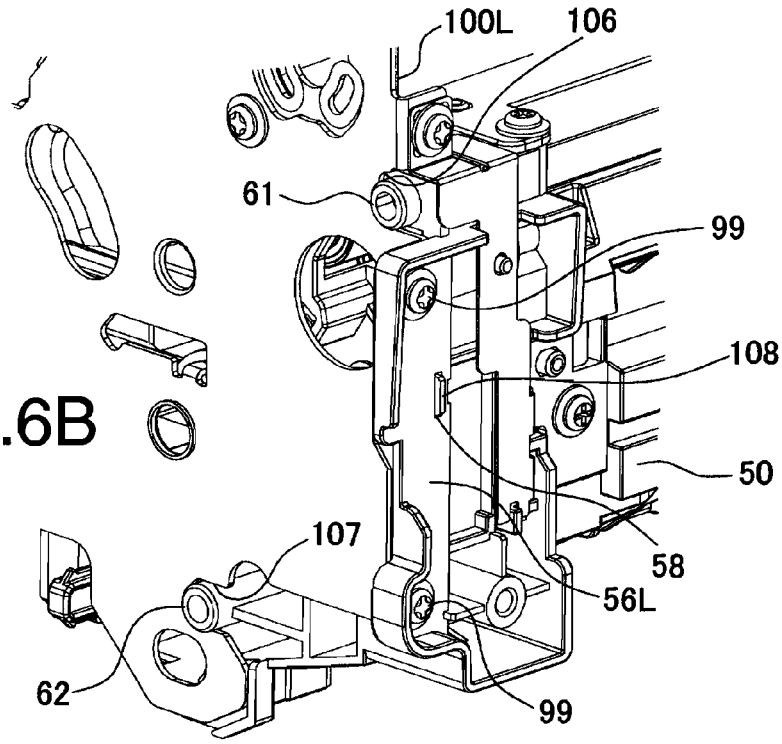
FIG. 6B is an enlarged view of the attachment of the metal frame and the feeder unit in the printer according to the embodiment of the present invention.

Next, an attaching mechanism of the feeder unit 50 to the printer 1 will be described with reference to FIGS. 5, 6A, and 6B. As shown in FIG. 5, each of the metal frames 100 is formed to have a holder portion 103 at a lower portion of the front end thereof. More specifically, the holder portion 103 is formed to have a height approximately half of the entire height of the metal frame 100, and is bent outwardly along the up-down direction. Each holder portion 103 is angled at substantially 90 degrees to be perpendicular with respect to the inner surface of the metal frame 100. Each holder portion 103 is formed to have female screw holes 104 in the vicinity of an upper end and a lower end thereof respectively. The screw holes 104 are formed to have the screws 98 or the screws 99 screwed therein in the front-rear direction from the front toward the rear of the printer 1. Further, the metal frame 100 is formed to have approximately U-shaped curved cutouts 106 and 107 at an upper portion and a lower portion of the holder portion 103 respectively. The cutouts 106 and 107 are formed by, for example, stamping. The left-side metal frame 100L of the metal frames 100 is formed to have a projection 108, which extends and projects frontward from a plane of the left-side metal frame 100L except the holder portion 103.

The feeder unit 50 to be attached to the metal frames 100 is formed to have flange-like attachment portions 56L, 56R, which extend sideward or outward, at positions to oppose the holder portions 103 of the metal frames 100L, 100R respectively. The attachment portion 56L is formed to have holes 57L, through which the screws 99 penetrate when the feeder unit 50 is attached to the printer 1. The attachment portion 56R is formed to have holes 57R, through which the shoulders of the shouldered screws 98 penetrate when the feeder unit 50 is attached to the printer 1. The holes 57R are formed to have diameters larger in the left-right direction than the diameters of the shoulders of the shouldered screws 98. The attachment portion 56L is further formed to have a positioning slit 58, into which the projection 108 of the left-side metal frame L is inserted when the feeder unit 50 is attached to the printer 1, so that the feeder unit 50 is prevented from being displaced in the right-left direction. Thus, the feeder unit 50 is fixed to the printer 1 by the positioning slit 58 and the projection 108 in the right-left direction.

Meanwhile, dimensional difference due to different temperatures in the feeder unit 50 and the metal frames 100 is absorbed by the attachment of the feeder unit 50 to the metal frames 100. More specifically, dimensional difference between the metal frames 100 and the feeder unit 50 due to temperature difference is substantially small in the positioning side (i.e., the left-hand side) of the feeder unit 50. Therefore, the feeder unit 50 can be fixed tightly to be immovable to the left-side metal frame 100L by the shoulderless screws 99. Meanwhile, dimensional difference due to temperature difference between the feeder unit 50 and the metal frames 100 may likely to occur in the right-hand side of the feeder unit 50. Therefore, the feeder unit 50 is attached to the right-side metal frame 100R by the shouldered screws 98 so that the feeder unit 50 is allowed to move in the right-left direction without being tightly fixed to the right-side metal frame 100R.

Further, the feeder unit 50 is formed to have cylindrical bosses 61 and bosses 62. The width of the feeder unit 50 corresponds to the distance between the inner surfaces of the left-side metal frame 100L and the right-side metal frame 100R, and the bosses 61 and the bosses 62 substantially project outwardly in the right-left direction from the right side and the left side of the feeder unit 50, to be held in the cutouts 106, 107 respectively. In FIGS. 5 and 6, only the boss 61 and the boss 62 formed on the left-hand side of the feeder unit 50 are shown, and the boss 61 and the boss 62 formed on the right-hand side of the feeder unit 50 are omitted. When the feeder unit 50 with the bosses 61 and the bosses 62 is attached to the pair of metal frames 100, the bosses 61 and the bosses 62 are inserted in the cutouts 106 and the cutouts 107 respectively. According to the present embodiment, the pair of metal frames 100 and the feeder unit 50 are configured such that, when feeder unit 50 is brought close to the pair of metal frames 100 along a direction parallel with the inner surfaces of the metal frames 100, and the bosses 61 and the bosses 62 come to closed ends of the cutouts 106 and the cutouts 107 respectively, the holder portions 103, 103 and the attachment portions 56L, 56R are spaced apart from each other. The bosses 61, 62 are settled securely in the cutouts 106, 107 respectively when the shoulderless screws 99 and the shouldered screws 98 attach the attachment portions 56L, 56R to the holder portions 103, 103. The closed-end portion of each of the cutouts 107 is formed to have an internal height being substantially equivalent to an outer diameter of the boss 62, and sets the boss 62 in a correct position with respect to the up-down direction vertically and front-rear direction horizontally. Meanwhile, the closed-end portion of each of the cutouts 106 is formed to have an internal height in the up-down direction being larger than an outer diameter of the boss 61, and sets the boss 61 in a correct position solely with respect to the front-rear direction horizontally.

As illustrated in FIG. 1, although not actually appear in the cross-section in the widthwise center of the printer 1, the boss 61 is disposed in the vicinity of the register rollers 54, 55, and the boss 62 is disposed in the vicinity of the separator roller 52. Therefore, when the feeder unit 50 is attached to the pair of frames 100 with the bosses 61 disposed in the horizontally correct positions but vertically within a predetermined range corresponding to the internal height of the cutouts 106, whilst the bosses 62 are disposed in the vertically and horizontally correct positions, the separator roller 52 is disposed in a vertically correct position more preferentially over the register rollers 54, 55 disposed in a predetermined allowable vertical range corresponding to the internal height of the cutouts 106. It is to be noted that, when the vertical positions of the register rollers 54, 55 are displaced within the vertically allowable ranges, the sheet feeding path to feed the recording sheet P may be displaced vertically, but in the predetermined range which is allowable. On the other hand, when, for example, the vertical position of the separator roller 52 is displaced, the displacement may affect sheet-separating functionality of the separator roller 52 in cooperation with the separator pad 72 which is separately provided to the sheet cassette 70. Therefore, it is desirable that the separator roller 52 is disposed in the vertically correct position preferentially.

Further, for example, while the positions of the bosses 61 and the bosses 62 are vertically and horizontally restricted, the feeder unit 50 may be distorted when the feeder unit 50 is thermally expanded. When the bosses 61 are allowed to move vertically in the cutouts 106, however, the feeder unit 50 can be prevented from being distorted even when resin in the feeder unit 50 thermally expands.

Figure 7A:
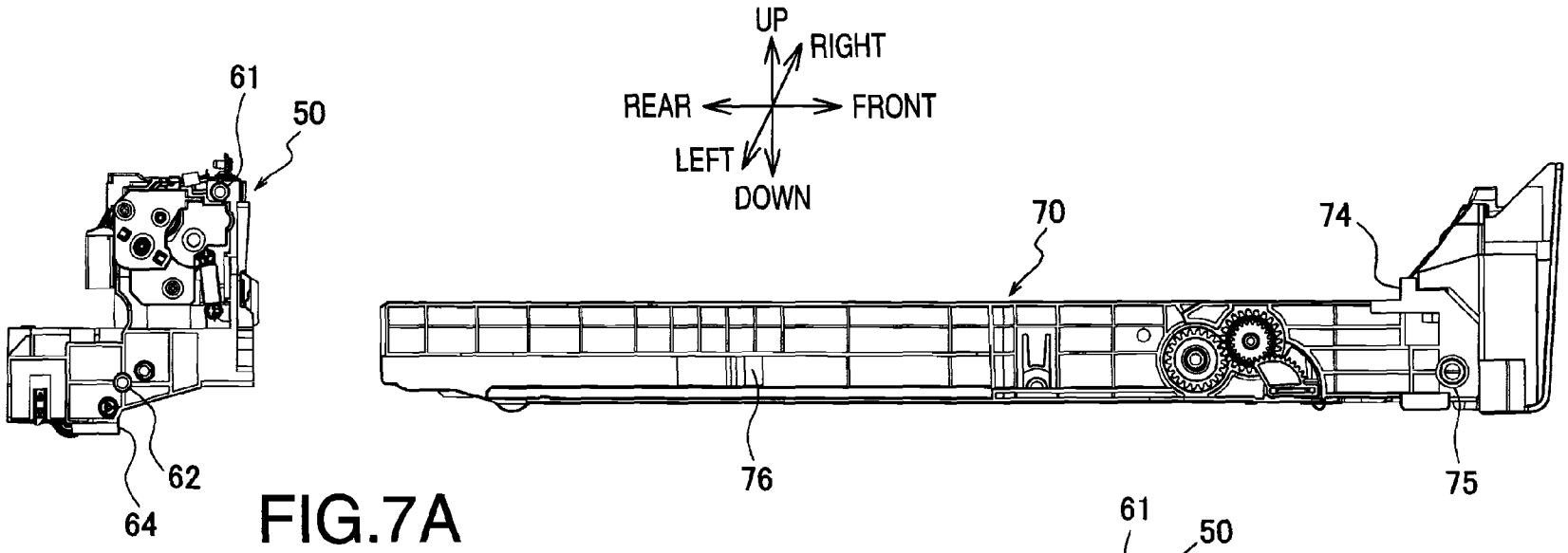
FIG. 7A is a side view of the feeder unit and a sheet cassette removed from a casing of the printer according to the embodiment of the present invention.
Figure 7B:
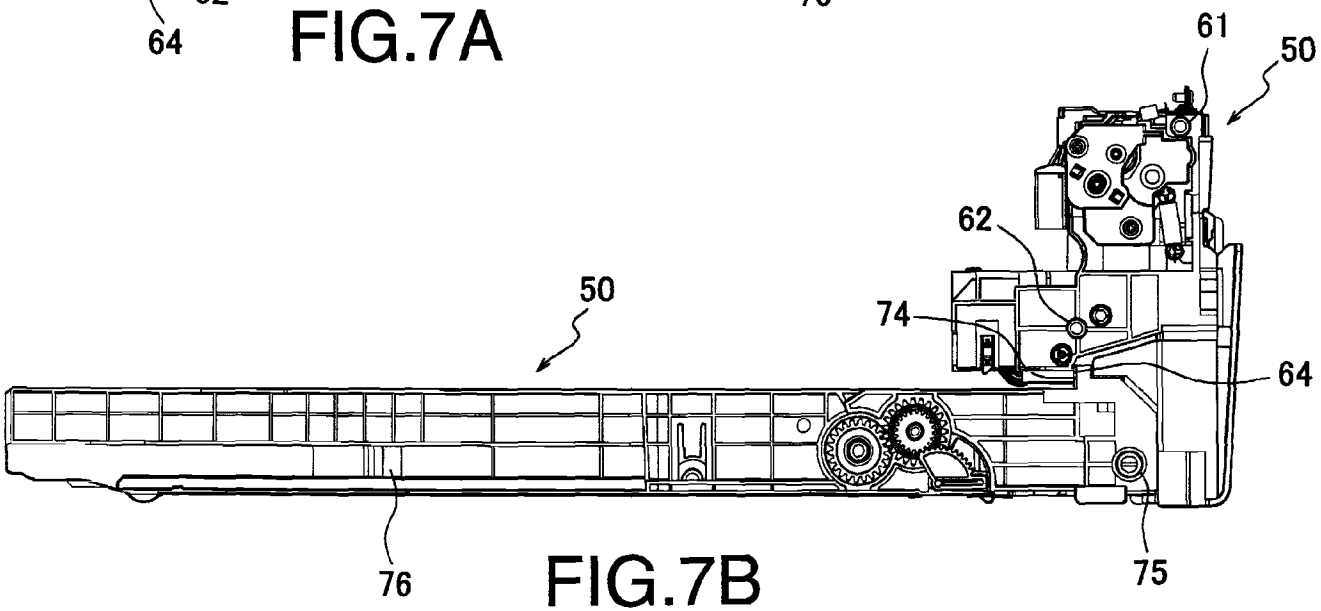
FIG. 7B is a side view of the feeder unit and the sheet cassette installed in the casing of the printer according to the embodiment of the present invention.

Next, a positioning mechanism of the sheet cassette 70 to the printer 1 will be described. As shown in FIGS. 7A, 7B, and FIG. 5, the feeder unit 50 is formed to have a vertical positioning edge 64, which is perpendicular to the front-rear direction and facing the front, at a bottom portion thereof. Meanwhile, the sheet cassette 70 is formed to have a positioning edge 74, which is perpendicular to the front-rear direction and facing the rear. When the sheet cassette 70 is installed in the casing 2 of the printer 1, as shown in FIG. 7B, the positioning edge 74 becomes in contact with the positioning edge 64 of the feeder unit 50 so that the sheet cassette 70 is disposed in a correct position in the printer 1.

When disposed in the casing 2 of the printer 1, the sheet cassette 70 is supported by a pair of support rails 370 (solely one on the right-side resin frame 300R is shown in FIGS. 2 and 3). The support rails 370 are formed to project inwardly from bottom ends of the resin frames 300L, 300R and support the sheet cassette 70 so that the sheet cassette 70 can slide on the support rails 370 to be installed in and retracted from the casing 2.

Further, as shown in FIGS. 7A, 7B, and 8A, the sheet cassette 70 is formed to have a boss 75 on each side and in the vicinity of the front end thereof, although one of the bosses 75 on the left-hand side is shown. Meanwhile, as shown in FIG. 8B, each of the resin frames 300L, 300R, on the other hand, is formed to have a recess 375, which is open toward the front and closed to the rear, at lower front end thereof. When the sheet cassette 70 is installed, the bosses 75 projecting outwardly in the right-left direction are fitted in the closed ends of the recesses 375 of the resin frames 300L, 300R respectively so that the front end of the sheet cassette 70 is vertically settled with respect to the resin frames 300L, 300R.

The sheet cassette 70 is further formed to have a projection 76, of which horizontal cross-sectional shape resembles a triangle with an angle projected outward, on each of the right and left sides and at a position closer to the rear end thereof. The projection 76 has an oblique plane closer to the front and an oblique plane closer to the rear. The oblique plane closer to the front is inclined in an angle more acute than an angle of the oblique plane closer to the rear.

Figure 9A:
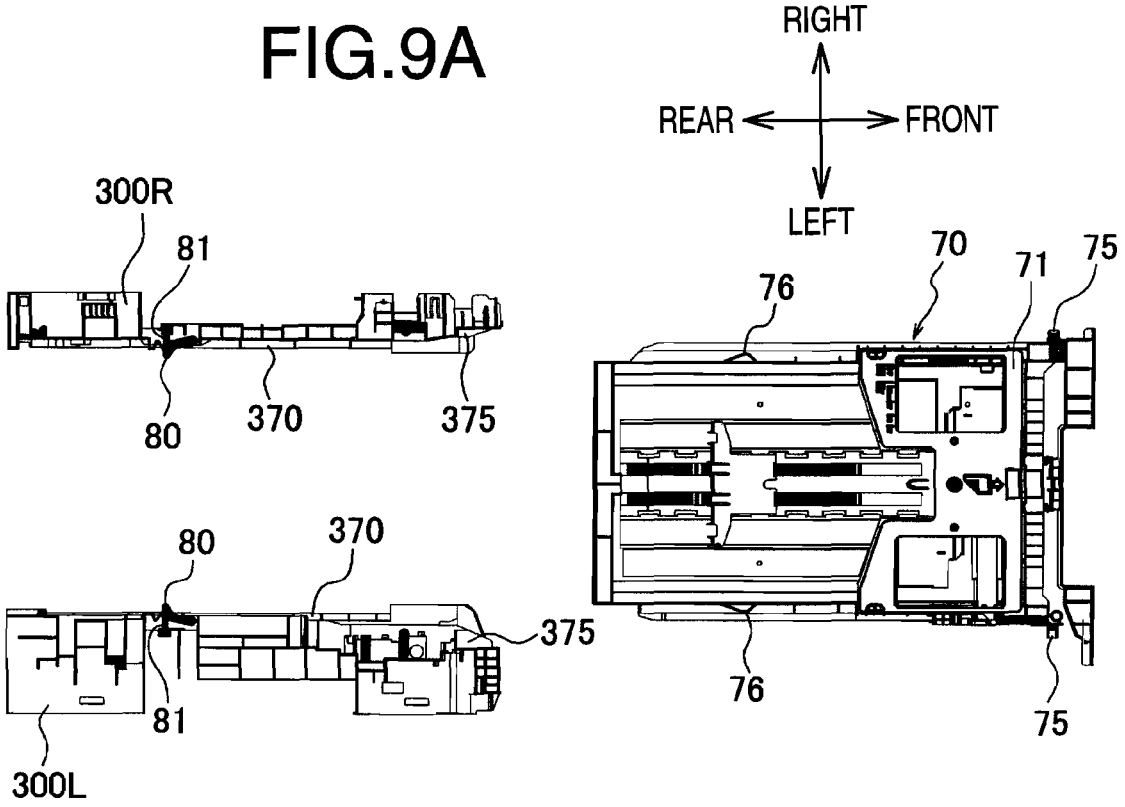
FIGS. 9A and 9B are top views of the sheet cassette and the positioning mechanism of the printer according to the embodiment of the present invention.
Figure 9B:
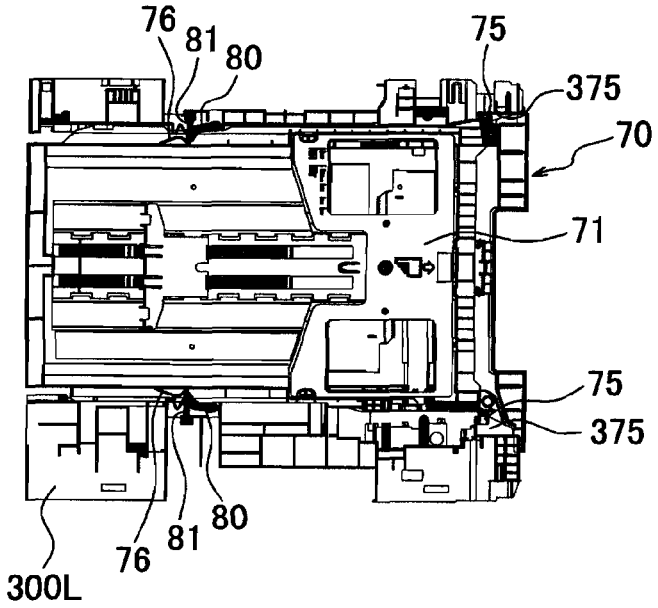

As shown in FIGS. 9A and 9B, each of the resin frames 300L, 300R is provided with a lock piece 80, which is biased inwardly by a compression spring 81 to project from the inner side surface of the resin frame 300L, 300R. When the sheet cassette 70 is installed in the casing 2, the projections 76 press the lock pieces 80 outward toward the resin frames 300L, 300R, and the projections 76 pass by the lock pieces 80. When the lock pieces 80 recover to the biased positions, the projections 76 are restricted by the lock pieces 80 from being moved reversely (i.e., frontward) so that the sheet cassette 70 is settled in the casing 2. Thus, the sheet cassette 70 is prevented from being withdrawn out of the casing 2 by movements of the printer 1 such as vibration.

Figure 10A:
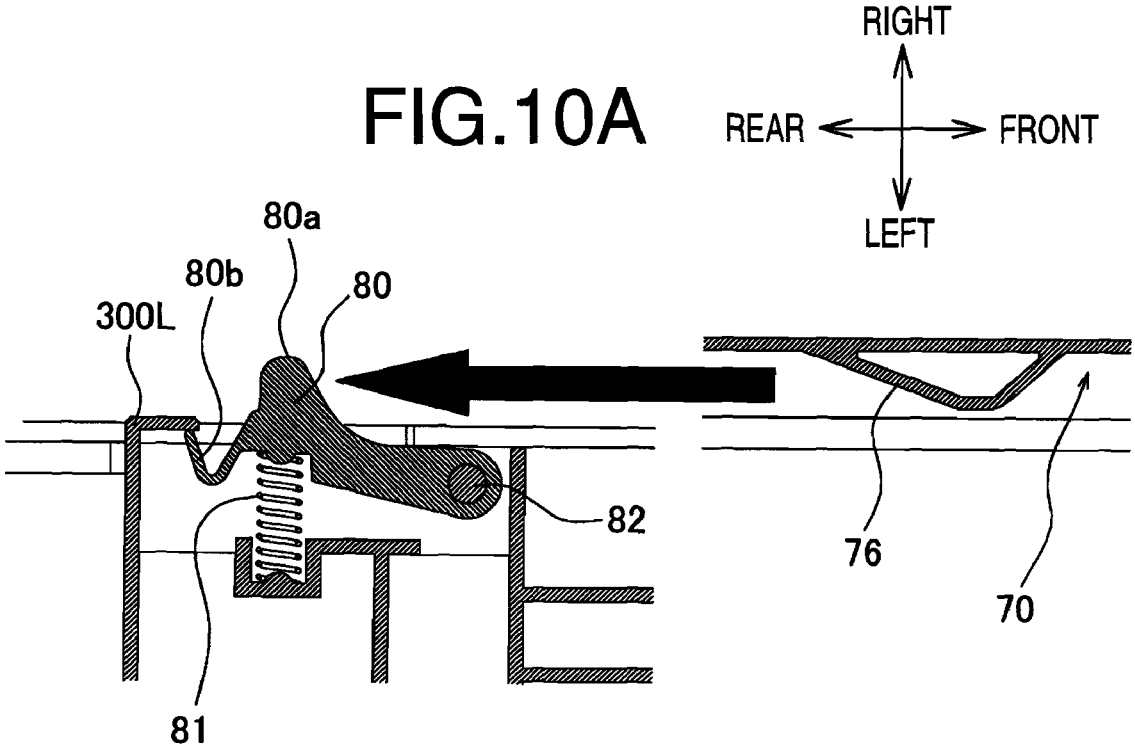
FIGS. 10A and 10B illustrate behaviors of the positioning mechanism in the printer according to the embodiment of the present invention.
Figure 10B:
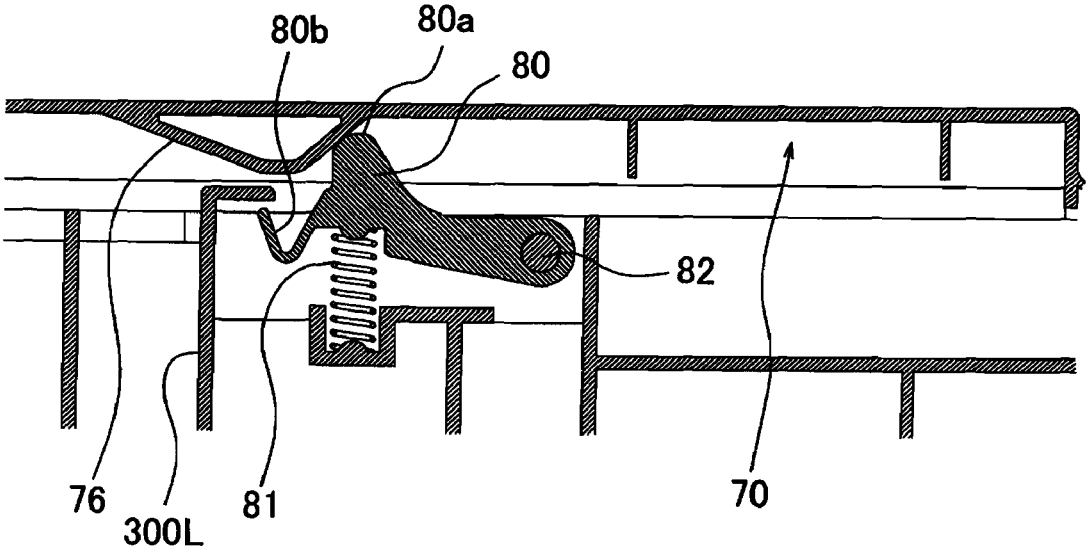

As shown in FIGS. 10A and 10B, each of the lock pieces 80 including a protrusive portion 80*a* and a restricting portion 80*b* is rotatable about a shaft 82, which is arranged to extend in a direction perpendicular to the resin frames 300L, 300R. The compression spring 81 is disposed between the resin frame 300 and the protrusive portion 80*a* to provide expanding force to the lock piece 80. It is to be noted that FIGS. 10A and 10B show the lock piece 80 with the left-side resin frame 300L, and the lock 80 with the right-side resin frame 300R is omitted. The lock piece 80 on the right-side resin frame 300R is in the similar but symmetrical configuration.

The restricting portion 80*b* of each of the lock pieces 80*b* is formed in adjacent to the protrusive portion 80*a* and restricts the protrusive portion 80*a* from being projected beyond a predetermined amount. The restricting portion 80*b* is formed to become in contact with a vertical plane of the resin frame 300 and stopped thereat when the protrusive portion 80*a* is biased inwardly by the compression spring 81. Therefore, the lock piece 80 is restricted from being rotated inwardly beyond the point in which the restricting portion 80*b* becomes in contact with the resin frame 300. Thus, the protrusive portion 80*a* is restricted against the expanding force of the compression spring 81 from being protruded inwardly beyond the predetermined amount.

Detailed behaviors of the lock piece 80 and the projection 76 will be described below. As indicated by an arrow in FIG. 10A, when the sheet cassette 70 is installed in the casing 2, the projection 76 presses the lock piece 80 by the protrusive portion 80*a* outwardly and passes thereby. When the positioning edge 74 becomes in contact with the positioning edge 64, i.e., the sheet cassette 70 becomes disposed in the correct position in the printer 1, the protrusive portion 80*a* of the lock piece 80 is in contact with the oblique plane of the projection 76 closer to the front, and the restricting portion 80*b* is not stopped by the resin frame 300 (see FIG. 10B). Therefore, the expanding force of the compression spring 81 is conveyed to the oblique plane of the projection 76 closer to the front without being restricted by the restricting portion 80*b*, and the sheet cassette 70 is pressed toward the rear of the printer 1. In this situation, the oblique plane of the projection 76 closer to the front is inclined in an angle more acute than the other oblique plane of the projection closer to the rear; therefore, the sheet cassette 70 can be effectively pressed toward the rear of the printer 1. Thus, the positioning edge 74 can become steadily in contact with the positioning edge 64 so that the sheet cassette 70 can be disposed in the horizontally correct position.

As has been described above, the feeder unit 50 is set in the correct position with respect to the metal frames 100 by inserting the pair of bosses 61 and the pair of bosses 62 in the cutouts 106 and the cutouts 107 respectively. The cutouts 106 and 107 can be stamp-formed in the metal frames 100, which is a more effective method to form a positioning structure than other methods such as the metal frames 100 being bent to dispose the feeder unit 50 or the cutouts being formed in the resin frames 300. Further, according to the above embodiment, the bosses 61 and 62 can be securely settled in the cutouts 106 and 107 by tightening the screws 98, 99.

Therefore, according to the above embodiment, the feeder unit 50 can be disposed in the accurate position with respect to the metal frames 100. Further, when the feeder unit 50 is in the correct position with respect to the metal frames 100, the processing cartridges 7 held by the metal frames 100 can be maintained in the correct positions with respect to the feeder unit 50 so that the images can be formed in correct positions on the recording sheet P being fed by the feeder unit 50. In the above embodiment, further, portions of the metal frames 100, where the guide grooves 101 to guide the processing cartridges 7 and the cutouts 106, 107 are provided, are formed in a same plane without a bent portion; therefore, the positional relation between the guide grooves 101 holding the processing cartridges 7 and the cutouts 106, 107 to hold the feeder unit 50 can be steadily maintained. Furthermore, in the above embodiment, the sheet cassette 70 can be also settled in the correct position with respect to the feeder unit 50 so that the sheet feeding path to convey the recording sheet P can be maintained steadily and the images can be formed in the correct position in the recording sheet P.

Furthermore, the metal frames 100L, 100R can be assembled together in correct positions with respect to each other by the flanged pipes 200, which can be fixed to the metal frames 100L by the screws 202 using a jig. In the above embodiment, the feeder unit 50 can be attached to front of the fixed assembly of the metal frames 100L, 100R so that the printer 1 can be assembled in the correct position.

It is to be noted that, for example, if the feeder unit 50 is attached to the metal frames 100, which does not directly define the position of the sheet cassette 70, the sheet cassette 70 is settled in the correct position with respect to the feeder unit 50 in the embodiment. Thus, accuracy of the positional relation between the feeder unit 50 and the sheet cassette 70 may be achieved.

Although an example of carrying out the invention has been described, those skilled in the art will appreciate that there are numerous variations and permutations of the image forming apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiment, the sheet cassette 70 is disposed in the horizontally correct position by having the positioning edge 64 of the feeder unit 50 in contact with the positioning edge 74 of the sheet cassette 70. However, the sheet cassette 70 may be disposed in a vertically correct position by, for example, having bosses inserted in U-shaped cutouts, similarly to the positioning mechanism of the metal frames 100 and the feeder unit 50. It is to be noted that, in such a positioning mechanism with the cutouts and the bosses, the recording sheet P may be fed even more steadily.

For another example, in the above embodiment, the pair of bosses 61 and the pair of bosses 62 are fitted in the U-shaped round cutouts 106 and 107. However, each of the bosses 61 and 62 may be inserted in a cutout with three linear sides and one opening. In such a case, the bosses 61 and/or 62 may be rectangular columns. Further, three or more pairs of bosses and cutouts may be provided. Furthermore, the bosses and cutouts are not necessarily provided evenly on each of the right and left sides of the feeder unit 50 and the metal frames 100. For example, one boss and a cutout may be provided on the right side of the feeder unit 50 and the right-side metal frame 100R while two bosses and two cutouts are provided on the left side of the feeder unit 50 and the left-side metal frame 100L.

Furthermore, the printer 1 may not necessarily be a multicolor-enabled LED printer, but may be, for example, a monochrome laser or LED printer, a multicolor-enabled or a single-color laser or inkjet printer, copier, or facsimile machine.

What is claimed is:

1. An image forming apparatus, comprising:

at least one image forming unit configured to form an image on a recording sheet which is conveyed along a sheet feeding path;

a feeder unit configured to feed the recording sheet in the sheet feeding path; and a frame unit configured to support the image forming unit and the feeder unit;

wherein the frame unit includes;

a pair of plate-like metal frames, each arranged on each side of the sheet feeding path, each plate-like metal frame having an inner surface extending in a parallel direction to the sheet feeding path and in a perpendicular direction of a surface of the recording sheet, the inner surfaces facing each other, and a plurality of connecting frames, which connect and hold the metal frames to be apart from each other, wherein the image forming unit is arranged in space defined by the plurality of connecting frames and is held by the pair of metal frames to be substantially fitted in between the pair of metal frames, and wherein the feeder unit is attached to an end of each of the pair of metal frames by an attachment system provided on each widthwise side of the feeder unit, the attachment system fixing the feeder unit to the pair of metal frames along a direction in parallel with the inner surfaces of the metal frames.

2. The image forming apparatus according to claim 1, further comprising:

a conveyor configured to convey the recording sheet in the sheet feeding path through the image forming unit; and a recording sheet container configured to contain recording sheets in a stack, the recording sheet being supplied to the conveyor via the feeder unit, wherein the image forming unit, the conveyor, and the recording sheet container are arranged to be overlapped with one another;

wherein the feeder unit is arranged in a direction perpendicular to the overlapping direction of the image forming unit, the conveyor, and the recording sheet container with respect to the conveyor; and wherein the feeder unit feeds the recording sheet supplied from the recording sheet container along an approximately U-shaped curve to the conveyor.

3. The image forming apparatus according to claim 2, wherein a plurality of image forming units are arranged along the sheet feeding path;

wherein the conveyor includes a conveyor belt extending along the sheet feeding path;

wherein the recording sheet container is arranged in parallel with the conveyor belt; and wherein the feeder unit includes a first roller to pick up the recording sheet from the recording sheet container and a second roller to feed the recording sheet picked up by the first roller to the conveyor belt.

4. The image forming apparatus according to claim 1, wherein each of the pair of metal frames has a guide groove to hold the image forming unit in a predetermined position within the space.

5. The image forming apparatus according to claim 4, wherein each of the pair of metal frames has a cutout portion, which is formed on a same plane with the guide groove at the end of each of the pair of metal frames to which the feeder unit is attached; and wherein the feeder unit includes a pair of projections, which project outwardly, the projections being inserted in the cutout portions along the direction in parallel with the inner surfaces of the metal frames.

6. The image forming apparatus according to claim 2, wherein the recording sheet container is removably installed in a predetermined installed position, in which the recording sheet container opposes the conveyor unit in the image forming apparatus; and wherein the feeder unit feeds the recording sheet from the recording sheet container to the conveyor unit and includes a positioning portion to position the recording sheet container in the predetermined installed position.

7. The image forming apparatus according to claim 4, wherein each of the pair of metal frames includes:

a cutout portion, which is formed on a same plane with the guide groove at the end of each of the pair of metal frames to which the feeder unit is attached; and an end surface, which is perpendicular to the inner surface of each of the metal frames;

wherein the feeder unit includes:

a pair of flange portions, each of which extends outwardly and has a surface to oppose the end surface of the metal frame; and a pair of projections, which project outwardly, the projections being inserted in the cutout portions along the direction in parallel with the inner surfaces of the metal frames; and wherein the pair of flange portions are spaced apart from the end surfaces of the metal frames with the pair of projections brought in contact with closed ends of the cutout portions of the metal frames.

8. The image forming apparatus according to claim 7, wherein the end surface of each of the metal frames is formed by bending each of the metal frames outwardly.

9. The image forming apparatus according to claim 1, wherein the plurality of connecting frames are linear pipes.

10. The image forming apparatus according to claim 1, wherein the image forming unit is removably installed in the space through an inlet provided at a top portion of the image forming apparatus;

wherein the plurality of connecting frames includes two upper connecting frames and two lower connecting frames; and wherein distance between the two upper connecting frames in a direction parallel with the inner surfaces of the metal frames is greater than distance between the two lower connecting frames in the direction parallel with the inner surfaces of the metal frames.

* * * * *